US010247421B2

(12) United States Patent
Gattermeyer et al.

(10) Patent No.: US 10,247,421 B2
(45) Date of Patent: Apr. 2, 2019

(54) TOOL AND METHOD FOR DECOUPLING CROSS-FIRE TUBE ASSEMBLIES IN GAS TURBINE ENGINES

(71) Applicant: General Electric Company, Schenectady, NY (US)

(72) Inventors: Todd James Gattermeyer, Hamilton, OH (US); James Robert Rodgers, Piedmont, SC (US); Stuart Craig Hanson, Fair Play, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 283 days.

(21) Appl. No.: 15/289,412

(22) Filed: Oct. 10, 2016

(65) Prior Publication Data

US 2018/0100654 A1 Apr. 12, 2018

(51) Int. Cl.

| | |
|---|---|
| ***F23R 3/60*** | (2006.01) |
| ***F23R 3/48*** | (2006.01) |
| ***B25B 27/02*** | (2006.01) |

(52) U.S. Cl.

CPC ..... *F23R 3/60* (2013.01); *B25B 27/023* (2013.01); *F23R 3/48* (2013.01); *F23R 2900/00017* (2013.01); *F23R 2900/00019* (2013.01)

(58) Field of Classification Search

CPC ..... B25B 27/023; F23R 2900/00017; F23R 2900/00019; F23R 3/48; F23R 3/60

See application file for complete search history.

(56) References Cited

U.S. PATENT DOCUMENTS

| | | | | |
|---|---|---|---|---|
| 2,036,782 | A * | 4/1936 | Ullmo | B25B 27/062 29/263 |
| 2,832,195 | A | 4/1958 | Weissborn, Jr. | |
| 4,642,866 | A * | 2/1987 | Murtaugh | B25B 27/062 29/259 |
| 5,440,778 | A | 8/1995 | DeGuzman | |
| 5,604,967 | A * | 2/1997 | McMahon | B25B 27/023 29/263 |
| 6,311,380 | B1 | 11/2001 | Chen | |
| 7,338,101 | B2 | 3/2008 | Quiroz | |
| 9,617,913 | B2 | 4/2017 | Oden et al. | |

(Continued)

OTHER PUBLICATIONS

Extended European Search Report and Opinion issued in connection with corresponding EP Application No. 17195760.8 dated Mar. 9, 2018.

*Primary Examiner* — Jacob J Cigna

(74) *Attorney, Agent, or Firm* — Dority & Manning, PA

(57) ABSTRACT

A tool for decoupling a telescoping tube from a first liner of a gas turbine engine is disclosed. The tool includes a rod partially positioned in a telescoping tube passage. The rod includes a first portion having a non-circular cross-section and a threaded second portion positioned in a second combustion chamber. A plug couples to the rod and engages a first side surface of the telescoping tube. A base defining a base passage extending therethrough is positioned in a second combustion chamber. The base passage includes a first portion having a non-circular cross-section. The first portion of the rod is at least partially positioned in the first portion of the base passage. A handle threadingly couples to the rod. Rotating the handle in a first direction moves the handle along the rod toward the first combustor to decouple the telescoping tube from the first liner.

16 Claims, 8 Drawing Sheets

(56) References Cited

U.S. PATENT DOCUMENTS

| | | | | |
|---|---|---|---|---|
| 2014/0137536 | A1 | 5/2014 | Cloninger et al. | |
| 2015/0052910 | A1* | 2/2015 | Perkins | F01D 25/00 60/800 |
| 2018/0085869 | A1 | 3/2018 | Gattermeyer et al. | |

* cited by examiner

TOOL AND METHOD FOR DECOUPLING CROSS-FIRE TUBE ASSEMBLIES IN GAS TURBINE ENGINES

FIELD OF THE TECHNOLOGY

The present disclosure generally relates to gas turbine engines. More particularly, the present disclosure relates to tools and methods for decoupling cross-fire tube assemblies in gas turbine engines.

BACKGROUND

A gas turbine engine generally includes a compressor section, a combustion section, and a turbine section. The compressor section progressively increases the pressure of the air entering the gas turbine engine and supplies this compressed air to the combustion section. The compressed air and a fuel (e.g., natural gas) mix within the combustion section before burning in one or more combustion chambers to generate high pressure and high temperature combustion gases. The combustion gases flow from the combustion section into the turbine section where they expand to produce mechanical rotational energy. For example, expansion of the combustion gases in the turbine section may rotate a rotor shaft connected, e.g., to a generator to produce electricity.

The combustion section typically includes a plurality of annularly arranged combustors, each of which receives compressed air from the compressor section. Each combustor generally includes an outer casing, a liner, and a flow sleeve. The outer casing surrounds the combustor and contains the compressed air received from the compressor section therein. The liner is positioned within the casing and defines at least a portion of a combustion chamber. The flow sleeve circumferentially surrounds at least a portion of the liner to define an annular plenum therebetween through which the compressed air may flow before entering the combustion chamber. One or more fuel nozzles supply the fuel to each combustor for mixing with the compressed air therein. This fuel air mixture flows into the combustion chamber where a spark plug or other ignition device may initiate combustion.

In certain configurations having multiple combustors in the combustion section, only some of the combustors may include a spark plug or other ignition device. In this respect, one or more cross-fire tube assemblies may propagate combustion between different combustion chambers. More specifically, each cross-fire tube assembly fluidly couples the combustion chamber in one combustor with the combustion chamber in an adjacent combustor. Accordingly, combustion in one combustion chamber may travel through the cross-fire tube assembly to ignite the fuel air mixture in an adjacent combustion chamber.

In order to facilitate the aforementioned fluid communication, the cross-fire tube assemblies must connect to the liners defining the combustion chambers. Certain combustor maintenance activities (e.g., replacement of the liner) may require that the cross-fire tube assembly be decoupled from the liner. Nevertheless, conventional tools and methods may cause undesirable rotation of the cross-fire tube assembly or a portion thereof during decoupling.

BRIEF DESCRIPTION OF THE TECHNOLOGY

Aspects and advantages of the technology will be set forth in part in the following description, or may be obvious from the description, or may be learned through practice of the technology.

In one aspect, the present disclosure is directed to a tool for decoupling a telescoping tube from a first liner of a first combustor of a gas turbine engine. The tool includes a rod having a first portion with a non-circular cross-section and a threaded second portion. The rod is configured for partial positioning in a telescoping tube passage defined by the telescoping tube such that the second portion of the rod is positioned in a second combustion chamber at least partially defined by a second combustor and the first portion of the rod is at least partially in the second combustion chamber. A plug couples to the rod. The plug is configured for engaging a first side surface of a first tube segment of the telescoping tube. A base defines a base passage extending therethrough. The base passage comprises a first portion having a non-circular cross-section. The first portion of the rod is at least partially positioned in the first portion of the base passage. A handle threadingly couples to the rod. Rotating the handle in a first direction moves the handle along the rod toward the first combustor to decouple the telescoping tube from the first liner.

Another aspect of the present disclosure is directed to a system for decoupling a telescoping tube from a first liner of a gas turbine engine. The system includes a first combustor having a first liner at least partially defining a first combustion chamber. A second combustor is positioned adjacent to the first combustor. The second combustor includes a second liner at least partially defining a second combustion chamber. A telescoping tube includes a first tube segment coupled to the first liner and a second tube segment biased apart from the first tube segment and coupled to the second liner. The telescoping tube defines a telescoping tube passage extending therethrough. A rod is partially positioned in the telescoping tube passage. The rod includes a first portion at least partially positioned in the second combustion chamber and a threaded second portion positioned in the second combustion chamber. The first portion of the rod includes a non-circular cross-section. A plug couples to the rod and engages a first side surface of the first tube segment. A base is positioned in the second combustion chamber. The base defines a base passage extending therethrough. The base passage includes a first portion having a non-circular cross-section. The first portion of the rod is at least partially positioned in the first portion of the base passage. A handle threadingly couples to the rod. Rotating the handle in a first direction moves the handle along the rod toward the first combustor to decouple the telescoping tube from the first liner.

A further aspect of the present disclosure is directed to a method for decoupling a telescoping tube from a first liner of a first combustor of a gas turbine engine. The method includes inserting a rod into a first combustion chamber at least partially defined by the first liner. The rod includes a first portion and a threaded second portion. The first portion includes a non-circular cross-section. The rod is positioned in a telescoping tube passage defined by a telescoping tube. The telescoping tube includes a first tube segment coupled to the first liner and a second tube segment biased apart from the first tube segment and coupled to a second liner of a second combustor. The second portion of the rod is positioned in a second combustion chamber at least partially defined by the second liner, and the first portion of the rod is at least partially positioned in the second combustion chamber. A plug coupled to the rod engages a first side surface of the first tube segment. A base is inserted into the second combustion chamber. The base defines a base passage extending therethrough. The base passage includes a first portion having a non-circular cross-section. The base is slid onto the rod. The base contacts the second liner, and the first portion of the rod is at least partially positioned in the first portion of the base passage. A handle is coupled the rod. The handle is rotated in a first direction to move the handle along the rod toward the first combustor to decouple the telescoping tube from the first liner.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended FIGS., in which.

Figure 1:
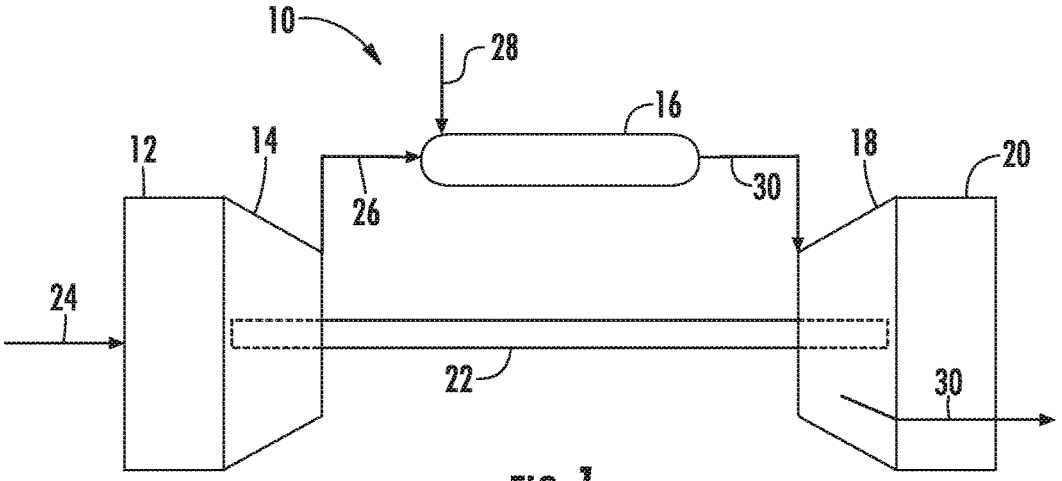
FIG. 1 is a functional block diagram of an exemplary gas turbine that may incorporate various embodiments of the present disclosure.

Repeat use of reference characters in the present specification and drawings is intended to represent the same or analogous features or elements of the present technology.

DETAILED DESCRIPTION OF THE TECHNOLOGY

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents. Although an industrial or land-based gas turbine is shown and described herein, the present technology as shown and described herein is not limited to a land-based and/or industrial gas turbine unless otherwise specified in the claims. For example, the technology as described herein may be used in any type of turbine including, but not limited to, aviation gas turbines (e.g., turbofans, etc.), steam turbines, and marine gas turbines.

Now referring to the drawings, wherein identical numerals indicate the same elements throughout the figures, FIG. 1 schematically illustrates an exemplary gas turbine engine 10. As depicted therein, the gas turbine engine 10 includes an inlet section 12, a compressor 14, one or more combustors 16, a turbine 18, and an exhaust section 20. The compressor 14 and turbine 18 may be coupled by a shaft 22, which may be a single shaft or a plurality of shaft segments coupled together.

During operation, the gas turbine engine 10 produces mechanical rotational energy, which may, e.g., be used to generate electricity. More specifically, air 24 enters the inlet section 12 of the gas turbine engine 10. In some embodiments, the inlet section 12 may include various filters, cooling coils, moisture separators, and/or other devices to purify and otherwise condition the air 24. From the inlet section 12, the air 24 flows into the compressor 14, where it is progressively compressed to provide compressed air 26 to each of the combustors 16. The compressed air 26 in each of the combustors 16 mixes with a fuel 28. The resulting fuel air mixture burns in each combustor 16 to produce high temperature and high pressure combustion gases 30. From the combustors 16, the combustion gases 30 flow through the turbine 18, which extracts kinetic and/or thermal energy therefrom. This energy extraction rotates the shaft 22, thereby creating mechanical rotational energy for powering the compressor 14 and/or generating electricity. The combustion gases 30 exit the gas turbine engine 10 through the exhaust section 20. In some embodiments, the exhaust section 20 may include, for example, a heat recovery steam generator (not shown) for cleaning and extracting additional heat from the combustion gases 30 prior to release to the environment.

Some embodiments of the gas turbine engine 10 include multiple combustors 16. In such embodiments, the combustors 16 may be annularly arranged can-type combustors.

Figure 2:
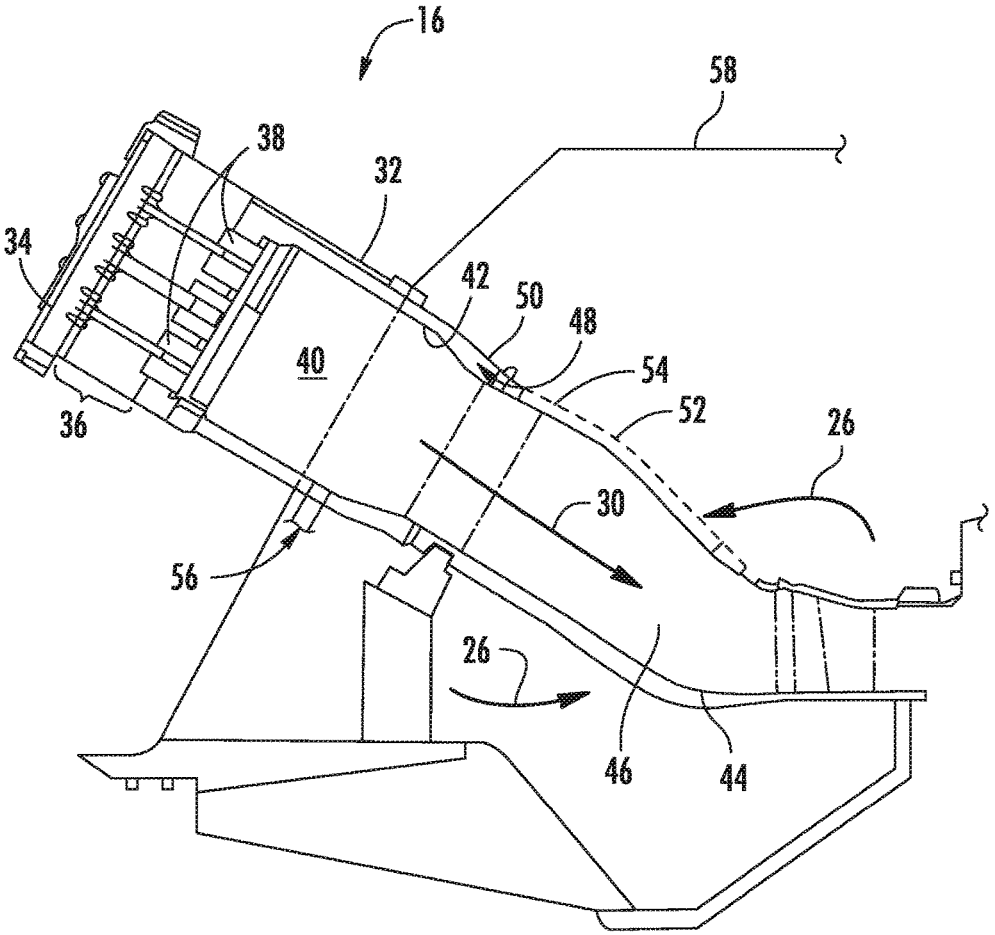
FIG. 2 is a simplified cross-sectional side view of an exemplary combustor that may incorporate various embodiments of the present disclosure.

FIG. 2 illustrates an exemplary embodiment of one of the combustors 16. In the embodiment depicted therein, the combustor 16 is a can-type combustor. More specifically, the combustor 16 includes an outer casing 32 that circumferentially encloses at least a portion thereof. In this respect, the outer casing 32 contains the compressed air 26 entering the combustor 16 from the compressor 14. The combustor 16 also includes an end cover 34 that couples to the outer casing 32. As shown in FIG. 2, the outer casing 32 and end cover 34 collectively define a head end volume 36 in the combustor 16. One or more fuel nozzles 38 may be arranged in the head end volume 36 to supply fuel 28, diluent, and/or other additives to a combustion chamber 40 located downstream from the head end volume 36. Possible fuels 28 may include, for example, blast furnace gas, coke oven gas, natural gas, methane, vaporized liquefied natural gas (LNG), hydrogen, syngas, butane, propane, olefins, diesel, petroleum distillates, and combinations thereof. A liner 42 positioned downstream of the head end volume 36 defines the combustion chamber 40 where the fuel air mixture is burned. A transition piece 44 positioned downstream from the liner 42 couples the combustor 16 to the turbine 18. As such, the liner 42 and the transition piece 44 partially define a hot gas path 46 through the combustor 16 for routing the combustion gases 30 to the turbine 18. Although, the combustor 16 may have different configurations in other embodiments.

The embodiment of the combustor 16 shown in FIG. 2 includes an annular plenum 48. More particularly, a flow sleeve 50 may circumferentially surround at least a portion of the liner 42. Similarly, an impingement sleeve 52 defining one or more flow apertures 54 extending therethrough may circumferentially surround at least a portion of the transition piece 44. In this respect, the liner 42, the transition piece 44, the flow sleeve 50, and impingement sleeve 52 collectively define the annular plenum 48. In operation, the compressed air 26 from the compressor 14 may enter the annular plenum 48 through the one or more flow apertures 54 in the impingement sleeve 52. As the compressed air 26 flows through the annular plenum 48 to the head end volume 36, it convectively cools the transition piece 44 and the liner 42. Upon reaching the head end volume 36, the compressed air 26 reverses direction and flows through the fuel nozzles 38 and into the combustion chamber 40.

As shown in FIG. 2, the gas turbine engine 10 includes one or more cross-fire tube assemblies 56 positioned inside of a compressor discharge casing 58. Each of the cross-fire tube assemblies 56 fluidly couples an adjacent pair of the combustors 16 to permit combustion to propagate therebetween. In the embodiment shown in FIG. 3, for example, one of the cross-fire tube assemblies 56 fluidly couples a first combustor 16A and an adjacent second combustor 16B. In this respect, combustion in, e.g., the first combustor 16A may travel through the cross-fire tube assembly 56 to the second combustor 16B. Nevertheless, the combustion may travel through the cross-fire tube assembly 56 from the second combustor 16B to the first combustor 16A as well. As such, every one of the combustors 16 in the gas turbine engine 10 need not have a spark plug or other ignition device. The gas turbine engine 10 may include as many or as few cross-fire tube assemblies 56 as is necessary or desired.

Figure 3:
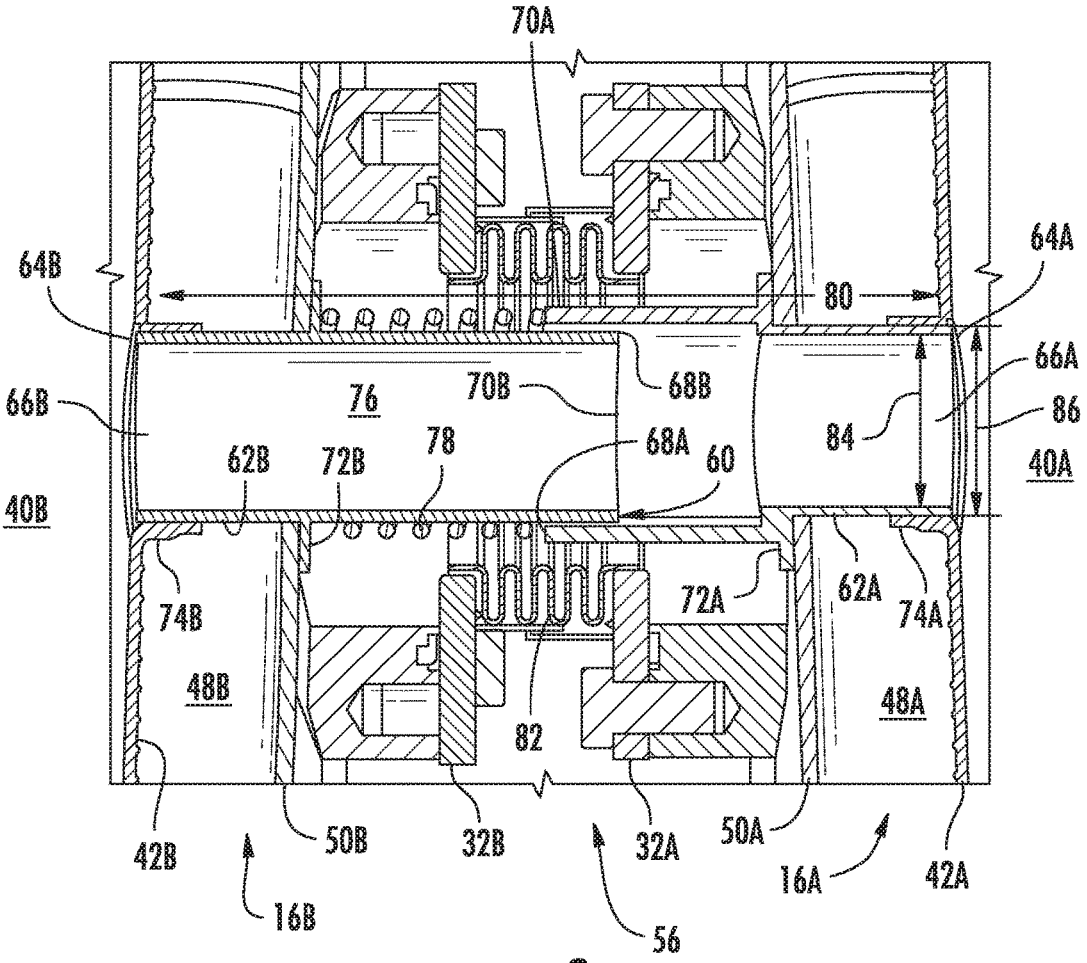
FIG. 3 is a cross-sectional side view of an exemplary cross-fire tube assembly extending between a first combustor and a second combustor.

As shown in FIG. 3, the crossfire tube assembly 56 generally includes an extendable or telescoping tube 60. More specifically, the telescoping tube 60 includes a first tube segment 62A and a second tube segment 62B in sliding engagement with the first tube segment 62A. The first tube segment 62A includes a first side surface 64A at a first end 66A thereof and a second side surface 68A at second end 70A thereof. Analogously, the second tube segment 62B includes a first side surface 64B at a first end 66B thereof and a second side surface 68B at second end 70B thereof. The first tube segment 62A couples to the first liner 42A, and the second tube segment 62B couples to the second liner 42B. The telescoping tube 60 has a narrowest inner diameter 84 and an outer diameter 86. As shown in FIG. 3, the outer diameter 86 is measured at the first end 66A of the first tube segment 62A and/or the first end 66B of the second tube segment 62B. Although generally illustrated as a cylindrical tube, the telescoping tube 60 may have any suitable geometric cross-section.

In order to propagate combustion between the first and the second combustors 16A, 16B, the telescoping tube 60 defines a telescoping tube passage 76. In particular, the telescoping tube passage 76 is in fluid communication with a first combustion chamber 40A of the first combustor 16A and a second combustion chamber 40B of the second combustor 16B. As such, the first tube segment 62A extends through a first outer casing 32A, a first flow sleeve 50A, and a first liner 42A of the first combustor 16A. Similarly, the second tube segment 62B extends through a second outer casing 32B, a second flow sleeve 50B, and a second liner 42B of the second combustor 16B.

Various flanges, bosses, or other detents that locate the telescoping tube 60 relative to the first and second combustors 16A, 16B. In the embodiment shown in FIG. 3, for example, the first and the second tube segments 62A, 62B respectively include a first flange 72A and a second flange 72B. As shown, the first and the second flanges 72A, 72B respectively locate the first and the second tube segments 62A, 62B against the first and the second flow sleeves 50A, 50B. In some embodiments, the first and the second liners 42A, 42B may respectively include a first boss 74A and a second boss 74B. The first ends 66A, 66B of the first and the second tube segments 62A, 62B respectively slide inside or outside of the first and the second bosses 74A, 74B to provide the aforementioned fluid communication between the telescoping tube 60 and the first and the second combustion chambers 40A, 40B. The first and the second bosses 74A, 74B also reduce or prevent the compressed air 26 from leaking into the telescoping tube 60 and/or the combustion gases 30 from leaking out of the telescoping tube 60. Furthermore, the first and the second bosses 74A, 74B respectively locate the first end 66A of the first tube segment 62A and the first end 66B of the second tube segment 62B at desired locations on the first and the second liners 42A, 42B. The first and the second flanges 72A, 72B may be integrally formed with, welded to, or otherwise fixedly coupled to the first and the second tube segments 62A, 62B. Similarly, the first and the second bosses 74A, 74B may be integrally formed with, welded to, or otherwise fixedly coupled to the first and the second liners 42A, 42B.

In the embodiment shown in FIG. 3, the cross-fire tube assembly 56 includes a bias 78 that biases the first and the second tube segments 62A, 62B apart. In this respect, the bias 78 respectively positively seats the first and the second flanges 72A, 72B against the first and the second flow sleeves 50A, 50B. Furthermore, the bias 78 couples the telescoping tube 60 to the first and the second liners 42A, 42B. In this respect, the bias 78 adjusts a length 80 of the telescoping tube 60 to accommodate varying distances and/or vibrations between the first and the second combustors 16A, 16B. As shown in FIG. 3, the bias 78 is a compression spring that circumferentially surrounds at least a portion of the second tube segment 62B and contacts the second side surface 68A of the first tube segment 62A. Nevertheless, the bias 78 may circumferentially surround at least a portion of the first tube segment 62A and contacts the second side surface 68B of the second tube segment 62B in other embodiments. Moreover, the bias 78 may be a tension spring, torsion spring, clutch, or other suitable biasing device in alternate embodiments.

In the embodiment shown in FIG. 3, the cross-fire tube assembly 56 may include a bellows 82 that circumferentially surrounds at least a portion of the telescoping tube 60. The bellows 82 may be welded or otherwise connected to the first outer casing 32A and the second outer casing 32B, thereby providing an expandable barrier between the first and the second combustors 16A, 16B. Some embodiments of the cross-fire tube assembly 56 may not include the bellows 82.

Figure 4:
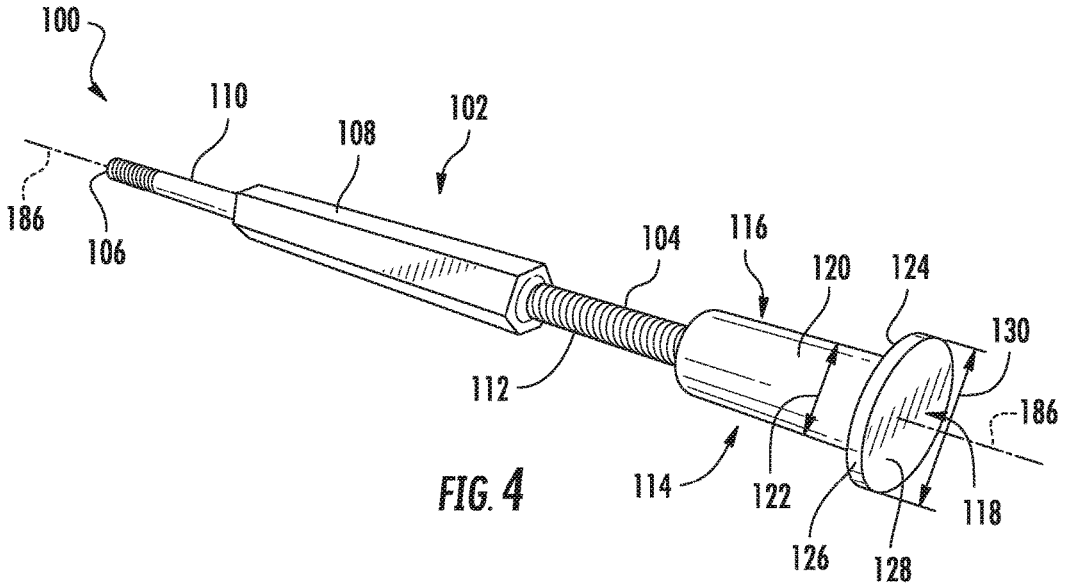
FIG. 4 is a perspective view of a rod and plug, which may be part of a tool for decoupling the cross-fire assembly in accordance with the embodiments disclosed herein.

FIGS. 4-7 illustrate various components of a tool 100 for decoupling the telescoping tube 60 of the cross-fire tube assembly 56 from the first liner 42A. Referring particularly to FIG. 4, the tool 100 includes a rod 102 having a longitudinal axis 186. As will be discussed in greater below, the rod 102 may be inserted into the telescoping tube passage 76 before decoupling the telescoping tube 60 from the first liner 42A. The rod 102 includes a first end 104 and a second end 106 spaced apart from the first end 104. Furthermore, the rod 102 includes a first portion 108 having a non-circular cross-section positioned between the first end 104 and the second end 106. The non-circular cross-section of the first portion 108 may be a triangular, rectangular, pentagonal, elliptical, D-shaped, or any other suitable non-circular shape. The rod 102 also includes a second portion 110 positioned at the second end 106 thereof. The second portion 110 has a circular cross-section and is threaded. In the embodiment shown in FIG. 4, the rod 102 also includes a third portion 112 positioned at the first end 104 thereof. In this respect, the first portion 108 is positioned between the second and the third portions 110, 112. The third portion 112 may have a circular cross-section and may be threaded like the second portion 110. Nevertheless, the third portion 112 may not be threaded and/or may have other cross-sections (e.g., a non-circular cross-section). Furthermore, some embodiments may not include the third portion 112. In such embodiments, the first portion 108 extends to the first end 104 of the rod 102.

The tool 100 includes a plug 114 that couples to the first end 104 of the rod 102. In the embodiment shown in FIG. 4, the plug 114 threadingly couples to the rod 102. Although, the plug 114 may be welded to, press-fit onto, or integrally coupled to the first end 104 of the rod 102 in other embodiments.

In the embodiment shown in FIG. 4, the plug 114 includes a body portion 116 and a flange portion 118. The body portion 116 includes an outer surface 120 and a body portion diameter 122. The flange portion 118 includes an inner surface 124, a side surface 126, an outer surface 128, and a flange portion diameter 130. As shown in FIG. 4, the body portion diameter 122 is smaller than the flange portion diameter 130. Moreover, the body portion diameter 122 should be smaller than the narrowest inner diameter 84 of the telescoping tube 60, thereby permitting the body portion 116 to fit in the passage 76 of the telescoping tube 60. Conversely, the flange portion diameter 130 should be greater than the narrowest inner diameter 84 of the telescoping tube 60 and smaller than the outer diameter 86 of the telescoping tube 60. In this respect, the flange portion 118 will not fit into the telescoping tube passage 76, but will not inhibit decoupling of the cross-fire tube assembly 56 from the combustor 16 as will be discussed in greater detail below. In the embodiment shown in FIG. 4, the body portion 116 and the flange portion 118 generally have circular cross-sections. In this respect, the plug 114 generally has a mushroom-like shape. Nevertheless, the plug 114 may have any suitable cross-section and/or configuration. In alternate embodiments, the plug 114 may only include the flange portion 118 and not the body portion 116.

Figure 5:
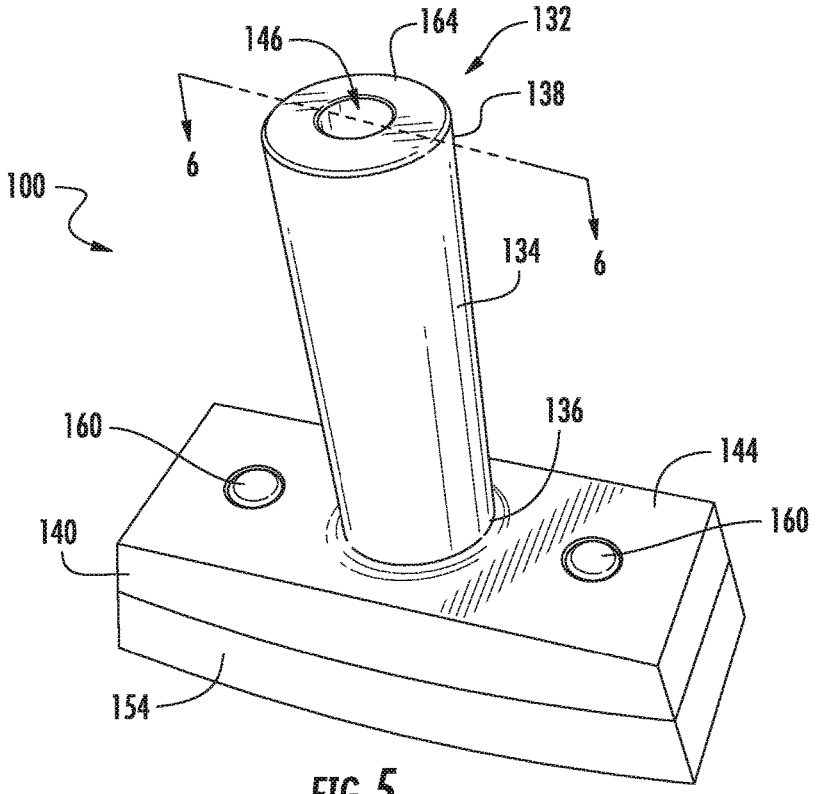
FIG. 5 is a perspective view of a base, which may be part of the tool for decoupling the cross-fire assembly in accordance with the embodiments disclosed herein.
Figure 6:
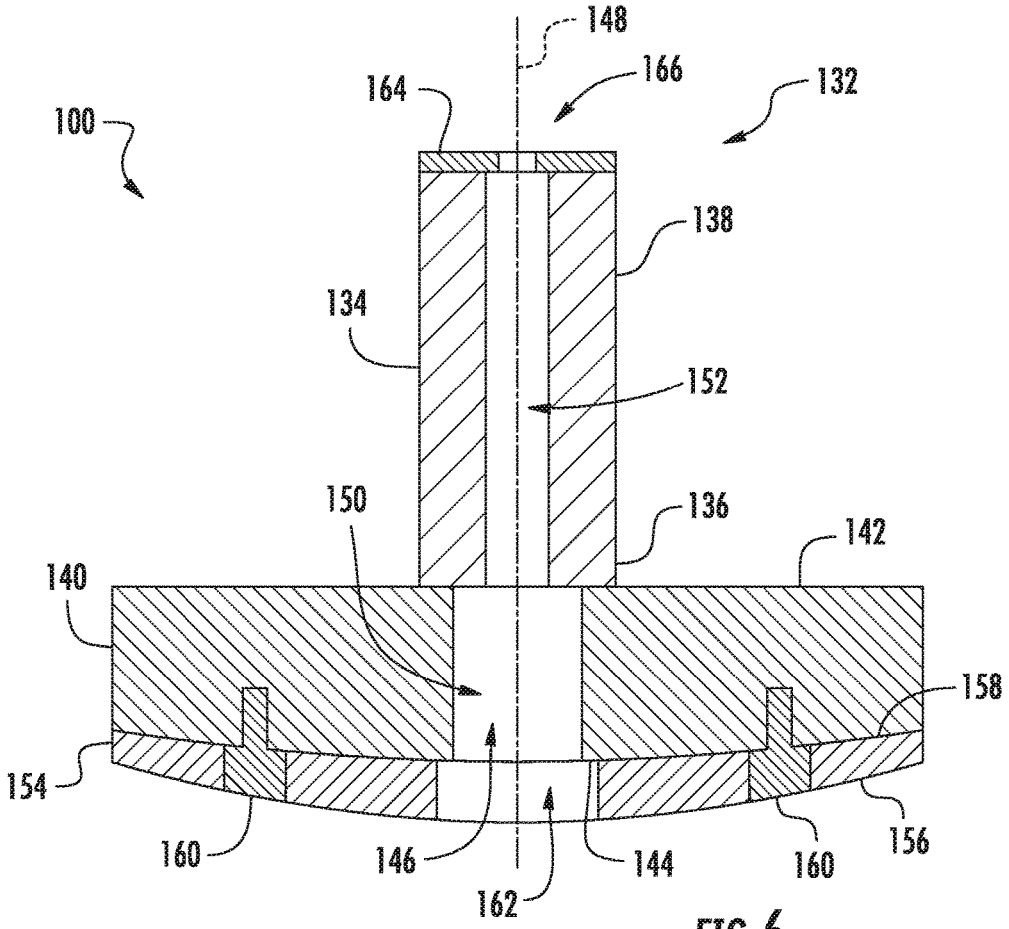
FIG. 6 is a cross-sectional view of the base taken generally about line 6-6 in FIG. 5, illustrating a base passage extending therethrough.

Referring now to FIGS. 5 and 6, the tool 100 also includes a base 132. More specifically, the base 132 includes a sleeve 134 having a first end 136 and a second end 138 spaced apart from the first end 136. Although depicted as having an annular cross-section, the sleeve 134 may have any suitable hollow geometric cross-section. The base 132 also includes a plate 140 having a first surface 142 and a second surface 144 spaced apart from the first surface 142. As best illustrated in FIG. 6, the first surface 142 may be arcuate to conform to the first and/or the second liners 42A, 42 to prevent the application of point loads thereon. The first end 136 of the sleeve 134 couples to the second surface 144 of the plate 140 via welding, press-fitting, threaded fasteners, or any other suitable connection method.

As best illustrated in FIG. 6, the base 132 defines a base passage 146 extending therethrough, which receives the rod 102 during decoupling of the cross-fire tube assembly 56. In particular, the base passage 146 defines a longitudinal axis 148 and extends from the first surface 142 of the plate 140 to the second end 138 of the sleeve 134.

As shown in FIG. 6, the base passage 146 includes a first portion 150 that at least partially receives the first portion 108 of the rod 102. In this respect, the first portion 150 of the base passage 146 generally has a non-circular cross-section. Specifically, the non-circular cross-section of the first portion 150 of the base passage 146 matches the non-circular cross-section of the first portion 108 of the rod 102. For example, if the first portion 108 of the rod 102 is hexagonal, the first portion 150 of the base passage 146 should also be hexagonal. As such, the mating of the non-circular first portion 108 of the rod 102 and the non-circular first portion 150 of the base passage 146 prevents the rod 102 from rotating relative to the base 132. In the embodiment shown in FIG. 6, the first portion 150 of the base passage 146 is entirely defined by the plate 140. That is, the first portion 150 of the base passage 146 occupies only a portion thereof. In other embodiments, the first portion 150 of the base passage 146 may be defined entirely by the sleeve 134 or partially by the sleeve 134 and partially by the plate 140. In further embodiments, such as those shown in FIGS. 11 and 12, the first portion 150 of the base passage 146 may occupy the entirety of the base passage 146.

In embodiments where the first portion 150 of the base passage 146 only occupies a portion thereof (e.g., the embodiment shown in FIG. 6), the base passage 146 may include a second portion 152. The second portion 152 of the base passage 146 preferably has a circular cross-section. Although, the second portion 152 of the base passage 146 may have any suitable non-circular cross-section different than the cross-section of the first portion 150. The second portion 152 of the base passage 146 may be defined entirely by the plate 140 (i.e., if the sleeve 134 defines the entirety of the first portion 150), entirely by the sleeve 134 (i.e., if the plate 140 defines the entirety of the first portion 150), or partially by the plate 140 and the sleeve 134. The diameter of the second portion 152 of the base passage 146 may be narrower than (as shown in FIG. 6), the same as, or wider than the diameter of the first portion 150 of the base passage 146.

In some embodiments, such as the one shown in FIGS. 5 and 6, the base 132 may include an elastomeric pad 154 that couples to the second surface 144 of the plate 140. The elastomeric pad 154 includes a first surface 156 and a second surface 158 spaced apart from the first surface 156. The first surface 156 contacts the first and/or the second liners 42A, 42B to prevent the plate 140 from scratching the combustor 16 or any coatings thereon during use of the tool 100. In this respect, the first surface 156 of the elastomeric pad 154 may be arcuate as shown in FIG. 6 to conform to the curvature of the first and/or the second liners 42A, 42B. The second surface 158 of the elastomeric pad 154 couples to the first surface 142 of the plate 140. As such, the second surface 158 of the elastomeric pad 154 may be arcuate if the first surface 142 of the plate 140 is arcuate as shown in FIG. 6. In the embodiment shown in FIGS. 5 and 6, a pair of threaded fasteners 160 couples the elastomeric pad 154 to the plate 140. Although, the elastomeric pad 154 may couple to the plate 140 using adhesive (not shown) or any other suitable attachment method. Furthermore, the elastomeric pad 154 defines an elastomeric pad portion 162 of the base passage 146. That is, the base passage 146 extends through the elastomeric pad 154. The elastomeric pad 154 may be formed from rubber or any other suitable material. Some embodiments of the base 132 may not include the elastomeric pad 154.

In the embodiment shown in FIGS. 5 and 6, the base 132 may further include a cap plate 164 coupled to the second end 138 of the sleeve 134. The cap plate 164 is generally oriented perpendicularly relative to the longitudinal axis 148 of the base passage 146. Furthermore, the cap plate 164 defines a cap plate portion 166 of the base passage 146. That is, the base passage 146 extends through the cap plate 164. The cap plate portion 166 is narrower than the remainder of the base passage 146 so as to act as a positive stop for the first portion 108 of the rod 102 as will be discussed in greater detail below. As shown in FIGS. 5 and 6, the cap plate 164 may be a washer or any suitable plate-like structure welded to the second end 138 of the sleeve 134. Nevertheless, the cap plate 164 may couple to the sleeve 134 via mechanical fasteners, press-fitting, or any other suitable connection method. Some embodiments of the base 132 may not include the cap plate 164.

Figure 7:
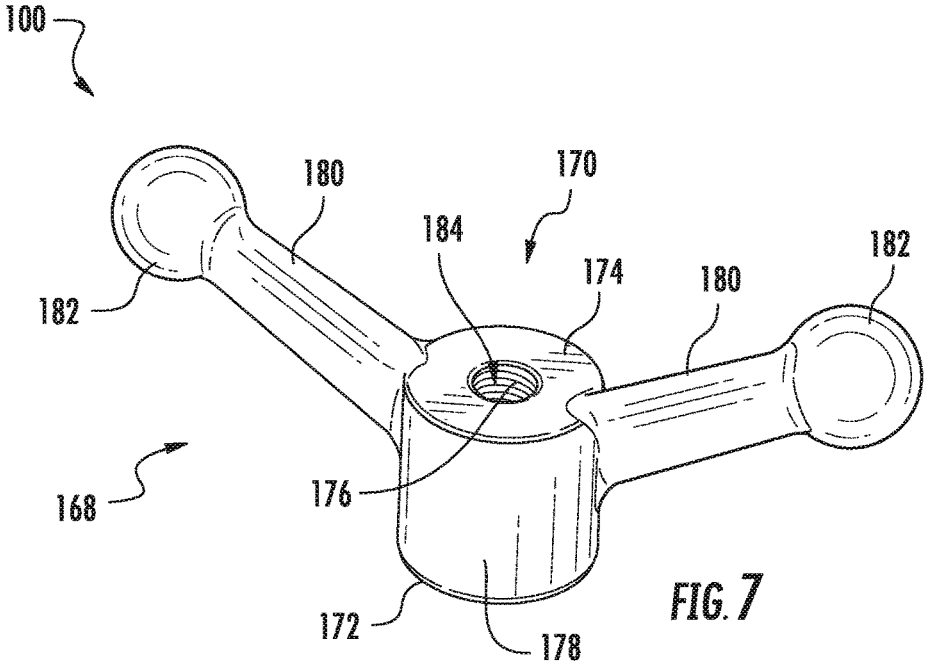
FIG. 7 is a perspective view of a handle, which may be part of the tool for decoupling the cross-fire assembly in accordance with the embodiments disclosed herein.

Referring now to FIG. 7, the tool 100 includes a handle 168 that threadingly couples to the rod 102 to slide the rod 102 relative to the base 132. The handle 168 includes an annular body 170 having a first surface 172, a second surface 174 spaced apart from the first surface 172, an inner surface 176, and an outer side surface 178. The inner surface 176 defines a handle passage 184 extending through the annular body 170 and is threaded to threadingly engage the second portion 110 of the rod 102. One or more arms 180 may extend outwardly from the outer side surface 178 of the annular body 170 to improve grip of the handle 168. In the embodiment shown in FIG. 7, two arms 180 extend outwardly from the outer side surface 178. In other embodiments, however, zero, one, three, four, or more arms 180 may extend outwardly from the annular body 170. Furthermore, in some embodiments, a spherical knob 182 may optionally be coupled to the end of each arm 180. The handle 168 may be integrally formed or formed from separate components welded or otherwise coupled together. In alternative embodiments, the handle 168 may have any suitable configuration. For example, the handle 168 may simply be a nut or any other suitable fastener that threadingly engages the second portion 110 of the rod 102.

Figure 8:
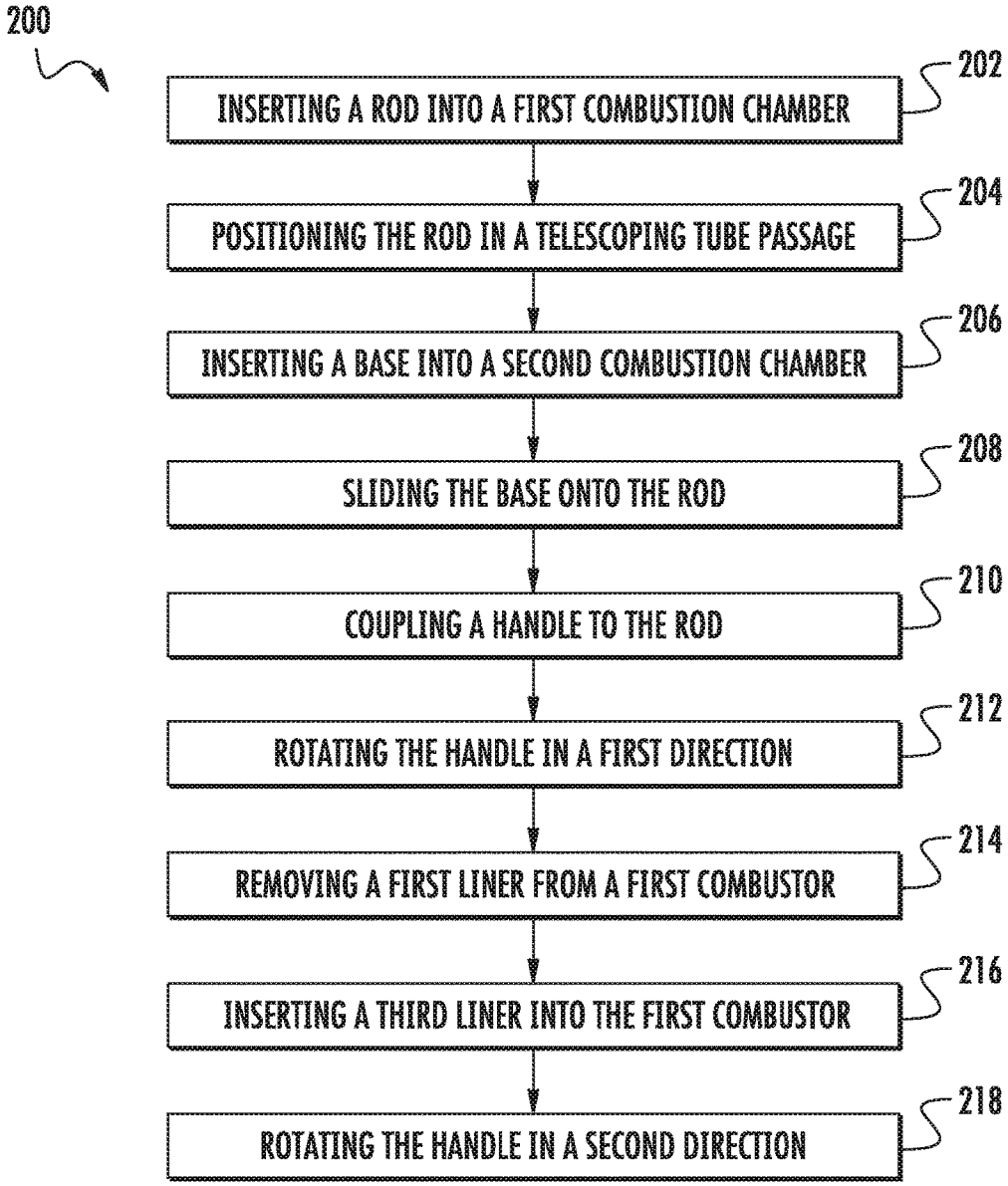
FIG. 8 is a flow chart illustrating a method for using the tool for decoupling the cross-fire assembly in accordance with the embodiments disclosed herein.

FIG. 8 is a flowchart illustrating an exemplary method 200 for using the tool 100 to decouple the telescoping tube 60 from the first liner 42A in accordance with the embodiments disclosed herein. FIGS. 9-13 illustrate various steps of the method 200. The bellows 82 is omitted for clarity in FIGS. 9-13. In step 202, the rod 102 is inserted into the first combustion chamber 40A defined by the first liner 42A in the first combustor 16A.

Figure 9:
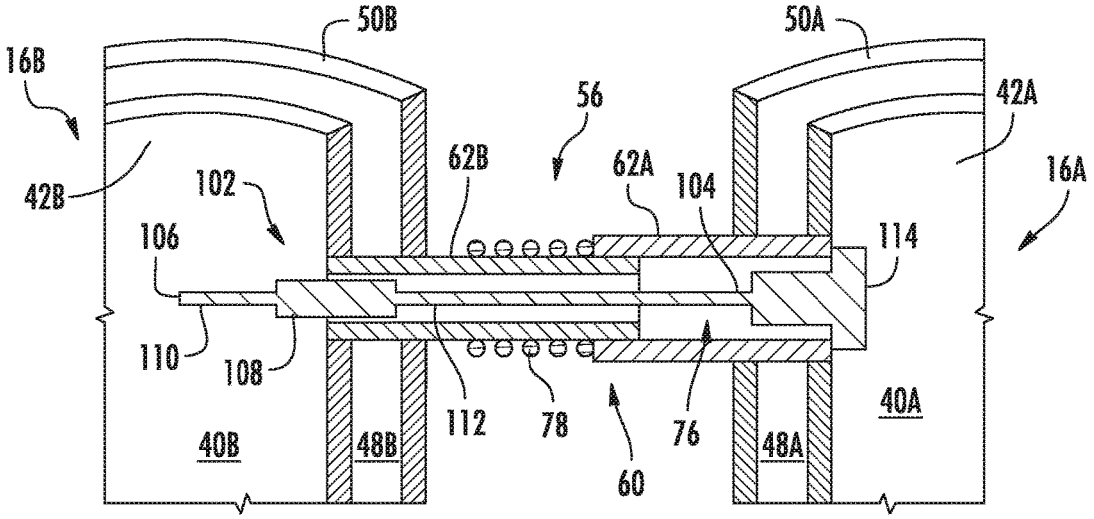
FIG. 9 is a cross-sectional view of the cross-fire tube assembly, illustrating the positioning of the rod therein.

In step 204, the rod 102 is positioned in the telescoping tube passage 76. FIG. 9 illustrates the positioning of the rod 102 in the telescoping tube passage 76 upon completion of step 204. As depicted, the rod 102 extends through the telescoping tube passage 76 and into the second combustion chamber 40B. That is, a portion of the rod 102 is positioned in the second combustion chamber 40B after step 204 is completed. In particular, the second portion 110 of the rod 102 is entirely positioned in the second combustion chamber 40B, while the first portion 108 of the rod 102 need only be at least partially positioned in the second combustion chamber 40B. In the embodiment shown in FIG. 9, the first portion 108 of the rod 102 is partially positioned in the second combustion chamber 40B and partially positioned in the telescoping tube passage 76. Nevertheless, the first portion 108 of the rod 102 may be entirely positioned within the second combustion chamber 40B in other embodiments.

Figure 10:
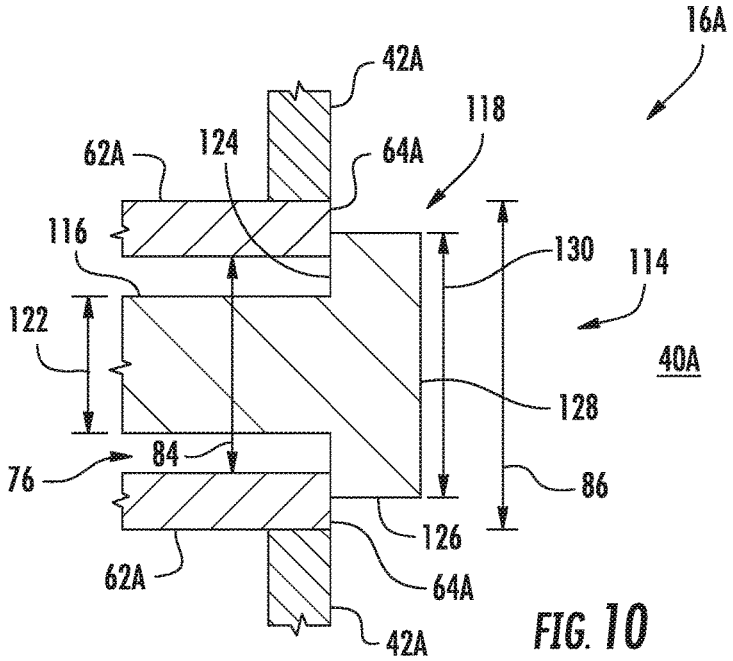
FIG. 10 is an enlarged cross-sectional view of a first end of the cross-fire tube assembly, illustrating the positioning of the plug relative to the cross-fire tube assembly.

FIG. 10 shows the relative positioning of the plug 114 and the telescoping tube 60 after completing step 204. As mentioned above, the body portion diameter 122 of plug 114 is smaller than the narrowest inner diameter 84 of the telescoping tube 60. In this respect, the body portion 116 of the plug 114 is positioned in the telescoping tube passage 76. Conversely, the flange portion diameter 130 is greater than the narrowest inner diameter 84 of the telescoping tube 60 and less than the outer diameter 86 of the telescoping tube 60. As such, the flange portion 118 is too wide to fit in the telescoping tube passage 76, but too narrow to contact the first liner 42A. In this respect, the inner surface 124 of the flange portion 118 contacts the first side surface 64A of the first tube segment 62A.

Next, the base 132 and the handle 168 are installed. More specifically, the base 132 is inserted into the second combustion chamber 40B defined by the second liner 42B in the second combustor 16B. In step 208, the base 132 slides onto the second end 106 of the rod 102. The handle 168 couples to the second end 106 of the rod 102 in step 210. In particular, the threaded inner surface 176 of the annular body 170 of the handle 168 engages the threaded second portion 110 of the rod 102, thereby threadingly coupling the handle 168 and the rod 102.

Figure 11:
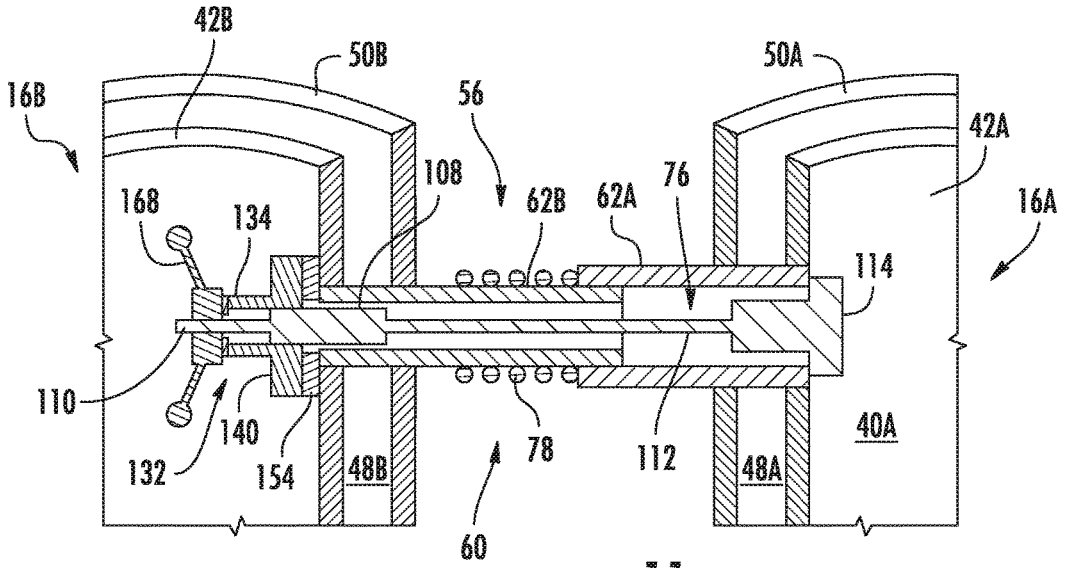
FIG. 11 is a cross-sectional view of the first combustor, the cross-fire tube assembly, and the second combustor, illustrating the base and the handle coupled to the rod.
Figure 12:
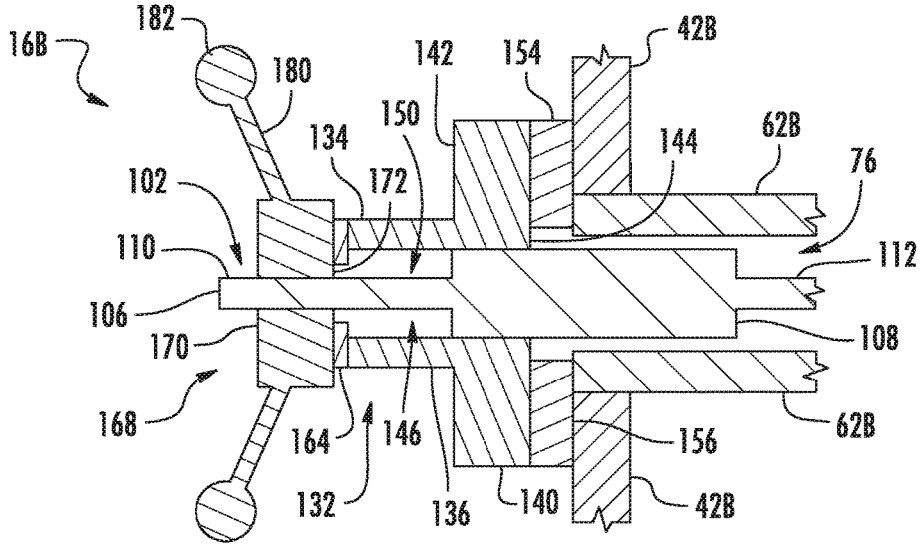
FIG. 12 is an enlarged cross-sectional view of the second combustor, illustrating the base and handle positioned therein.

FIGS. 11 and 12 illustrate the relative positioning of the rod 102, the base 132, and the handle 168 after step 210 is complete. As shown, the base 132 is in contact with the second liner 42B. In the embodiment shown in FIG. 11, the base 132 includes the elastomeric pad 154. As such, the first surface 156 of the elastomeric pad 154 contacts the second liner 42B. Although, the second surface 144 of the plate 140 contacts the second liner 42B in embodiments where the base 132 does not include an elastomeric pad 154.

As best illustrated in FIG. 12, the portion of the rod 102 positioned in the second combustion chamber 40A extends through the base passage 146 defined by the base 132. More specifically, the first portion 108 of the rod 102 is at least partially positioned in the first portion 150 of the base passage 146. As such, the non-circular cross-sections of the first portion 108 of the rod 102 and the first portion 150 of the base passage 146 prevent the rod 102 from rotating about the longitudinal axis 186 thereof relative to the base 132. As mentioned above and shown in FIGS. 11 and 12, the first portion 108 of the rod 102 may also be partially positioned in the telescoping tube passage 76 in some embodiments. The second portion 110 of the rod 102 extends out of the base passage 146 and away from the cross-fire tube assembly 56. That is, the second portion 110 of the rod 102 is partially positioned in the base passage 146 and partially positioned outside of the base 132. The section of the second portion 110 of the rod 102 positioned in the base passage 146 may be positioned in the first portion 150 of the base passage 146, in the second portion 152 of the base passage 146 (FIG. 6), or in some combination thereof.

In step 212, the handle 168 is rotated to move the plug 114 toward the second combustor 16B. More specifically, rotating the handle 168 in a first direction (e.g., clock-wise) causes it to move along the threaded second portion 110 of the rod 102 toward the cross-fire tube assembly 56 and the first combustor 16A. FIGS. 11 and 12 show the position of the handle 168 after it has moved along the second portion 110 of the rod 102 a sufficient distance to contact the cap plate 164 of the base 132. If the base 132 does not include the cap plate 164, the handle 168 will contact the sleeve 134. Contact between the handle 168 and the base 132 prevents the handle 168 from continuing to move toward the first combustor 16A. Once this occurs, rotation of the handle 168 in the first direction causes the rod 102 and the plug 114 to move toward the second combustor 16B. The mating of the non-circular first portion 108 of the rod 102 and the first portion 150 of the base passage 146 prevents the rod 102 from rotating relative to the base 132. As such, rotation of the handle 168 causes movement of the rod along the longitudinal axis 186 thereof.

Figure 13:
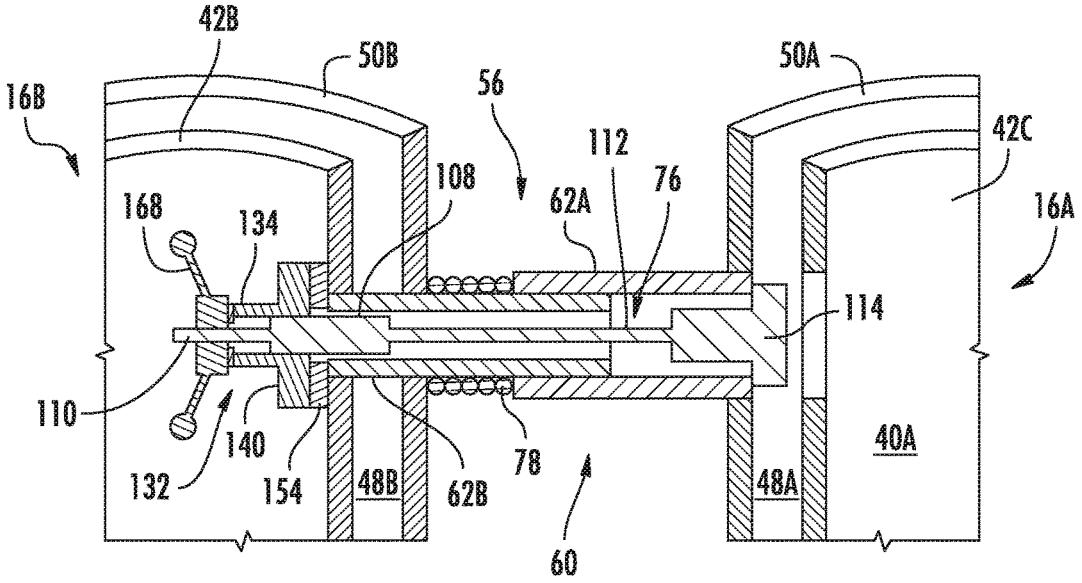
FIG. 13 is a cross-sectional view of the first combustor, the cross-fire tube assembly, and the second combustor, illustrating the cross-fire tube decoupled from the first liner.

As mentioned above, the flange portion 118 of the plug 114 is in contact with the first side surface 64A of the first tube segment 62A, but not the first liner 42A. As such, movement of the plug 114 toward the second combustor 16B, in turn, moves the first tube segment 62A toward the second combustor 16B. That is, the movement of the plug 114 overcomes the force exerted on the first tube segment 62A by the bias 78, thereby decoupling the first tube segment 62A from the first liner 42A. The cap plate 154, if present, provides a positive stop that circumscribes the maximum distance away from the first combustor 16A that the rod 102 and the plug 114 may move. FIG. 13 shows the cross-fire tube assembly 56 decoupled from the first liner 42A using the methods and embodiments disclosed herein. The telescoping tube 60 remains decoupled from the first liner 42A until the handle 168 is rotated in a second direction (e.g., counterclockwise) as will be discussed in greater detail below.

As mentioned above, some embodiments of the gas turbine engine 10 may include additional cross-fire tube assemblies 56 coupled to the first liner 42A. In such embodiments, additional tools 100 may be used to decouple the additional cross-fire tube assemblies 56 from the first liner 42A in accordance with the method 200.

Once the cross-fire tube assembly 56 is decoupled from the first combustor 16A, various maintenance operations may be performed thereon. For example, the first liner 42A may be replaced with a third liner 42C shown in FIG. 13. More specifically, the first liner 42A may be removed from the first combustor 16A in step 214. In step 216, the third liner 42A, which is a replacement for the first liner 42A, is inserted into the first combustor 16A. Other maintenance operations may be performed on the first combustor 16A after the cross-fire tube assembly 56 is decoupled from the first liner 42A.

In step 218, the handle 168 is rotated to move the plug 114 toward the first combustion chamber 40A. More specifically, rotating the handle 168 in a second direction (i.e., opposite to the first direction in step 212) causes the plug 114 to move toward the first combustion chamber 40A. As the plug 114 moves toward the first combustion chamber 40A, the bias 78 pushes the first tube segment 62A toward the first liner 42A. That is, the bias 78 maintains the contact between the inner surface 124 of the flange portion 118 and the first side surface 64A of the first tube segment 62A. Once the handle 168 is rotated a sufficient number of times, the plug 114 is positioned in the first combustion chamber 40A and the first tube segment 62A couples to the third liner 42C.

After step 218 is completed, the tool 100 may be removed from the gas turbine engine 10. More particularly, the handle 168 may be rotated in the second direction (i.e., in the same direction as step 218) until it disengages the second portion 110 of the rod 102. Once the handle 168 is removed, the base 132 may then slide off of the second end 106 of the rod 102. The rod 102 may be removed from the telescoping tube passage 76.

The tool 100 disclosed herein decouples the telescoping tube 60 of the cross-fire tube assembly 56 from the first liner 42A of the first combustor 16A. As discussed in greater detail above, the mating of the non-circular first portion 108 of the rod 102 and the non-circular first portion 150 of the base passage 146 prevents the rod 102 from rotating relative to the base 132. In this respect, and unlike conventional tools, this anti-rotation feature prevents the telescoping tube 60 or any other portion of the cross-fire tube assembly 56 from rotating during decoupling.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A tool for decoupling a telescoping tube from a first liner positioned in a first chamber of a first component, the tool comprising:

a rod comprising a first portion comprising a non-circular cross-section and a threaded second portion, wherein the rod is configured for partial positioning in a telescoping tube passage defined by the telescoping tube such that the second portion of the rod is positioned in a second chamber and the first portion of the rod is at least partially in the second chamber;

a plug coupled to the rod, the plug configured for engaging a first side surface of a first tube segment of the telescoping tube;

a base defining a base passage extending therethrough, the base passage comprising a first portion comprising a non-circular cross-section, wherein the first portion of the rod is at least partially positioned in the first portion of the base passage, the base further comprising an elastomeric pad including an arcuate surface configured to engage an arcuate wall defining the second chamber; and a handle threadingly coupled to the rod, wherein rotating the handle in a first direction moves the handle along the rod to decouple the telescoping tube from the first liner.

2. The tool of claim 1, wherein the base comprises a sleeve and a plate coupled to the sleeve.

3. The tool of claim 1, wherein the plug comprises a body portion and a flange portion.

4. A method for decoupling a telescoping tube from a first liner of a first combustor of a gas turbine engine, the method comprising:

inserting a rod into a first combustion chamber at least partially defined by the first liner, the rod comprising a first portion and a threaded second portion, the first portion comprising a non-circular cross-section;

positioning the rod in a telescoping tube passage defined by the telescoping tube, the telescoping tube comprising a first tube segment coupled to the first liner and a second tube segment biased apart from the first tube segment and coupled to a second liner of a second combustor, wherein the second portion of the rod is positioned in a second combustion chamber at least partially defined by the second liner and the first portion of the rod is at least partially positioned in the second combustion chamber, and wherein a plug coupled to the rod engages a first side surface of the first tube segment;

inserting a base into the second combustion chamber, the base defining a base passage extending therethrough, the base passage comprising a first portion comprising a non-circular cross-section, the base further comprising an elastomeric pad including an arcuate surface;

sliding the base onto the rod such that the base contacts an arcuate wall of the second liner and the first portion of the rod is at least partially positioned in the first portion of the base passage;

coupling a handle to the rod; and rotating the handle in a first direction to move the handle along the rod toward the first combustor to decouple the telescoping tube from the first liner.

5. The method of claim 4, wherein the plug comprises a flange portion comprising a flange portion diameter and the telescoping tube comprises an outer diameter and a narrowest inner diameter, and wherein the flange portion diameter is smaller than the outer diameter of the telescoping tube and larger than the narrowest inner diameter of the telescoping tube.

6. The method of claim 4, further comprising:

removing the first liner from the first combustor after the telescoping tube decouples from the first liner.

7. The method of claim 6, further comprising:

inserting a third liner into the first combustor after removing the first liner.

8. The method of claim 7, further comprising:

rotating the handle in a second direction to move the handle along the rod away from the first combustor to couple the telescoping tube to the third liner, the second direction being opposite of the first direction.

9. A system for decoupling a telescoping tube from a first liner of a gas turbine engine, the system comprising:

a first combustor comprising the first liner at least partially defining a first combustion chamber;

a second combustor positioned adjacent to the first combustor, the second combustor comprising a second liner at least partially defining a second combustion chamber;

a telescoping tube comprising a first tube segment coupled to the first liner and a second tube segment biased apart from the first tube segment and coupled to the second liner, the telescoping tube defining a telescoping tube passage extending therethrough;

a rod partially positioned in the telescoping tube passage, the rod comprising a first portion at least partially positioned in the second combustion chamber and a threaded second portion positioned in the second combustion chamber, the first portion of the rod comprising a non-circular cross-section;

a plug coupled to the rod, the plug engaging a first side surface of the first tube segment;

a base positioned in the second combustion chamber, the base defining a base passage extending therethrough, the base passage comprising a first portion comprising a non-circular cross-section, wherein the first portion of the rod is at least partially positioned in the first portion of the base passage, the base further comprising an elastomeric pad including an arcuate surface configured to engage an arcuate wall of the second liner; and a handle threadingly coupled to the rod, wherein rotating the handle in a first direction moves the handle along the rod toward the first combustor to decouple the telescoping tube from the first liner.

10. The system of claim 9, wherein the base comprises a plate coupled to the elastomeric pad.

11. The system of claim 9, wherein the base comprises a cap plate.

12. The system of claim 9, wherein the base comprises a sleeve and a plate coupled to the sleeve.

13. The system of claim 12, wherein the first portion of the base passage is entirely defined by the plate.

14. The system of claim 9, wherein the plug comprises a body, portion and a flange portion, and wherein the body portion comprises a body portion diameter and the flange portion comprises a flange portion diameter.

15. The system of claim 14, wherein the telescoping tube comprises a narrowest inner diameter, and wherein the body portion diameter is less than the narrowest inner diameter of the telescoping tube.

16. The system of claim 15, wherein the telescoping tube comprises an outer diameter, and wherein the flange portion diameter is greater than the narrowest inner diameter of the telescoping tube and less than the outer diameter of the telescoping tube.

* * * * *